US007104853B1

(12) United States Patent
Kepka

(10) Patent No.: US 7,104,853 B1
(45) Date of Patent: Sep. 12, 2006

(54) MARINE GIMBAL OUTDRIVE ASSEMBLY

(76) Inventor: Robert Thomas Kepka, 1010 Graces Landing Cir., Apt 102, Sebastian, FL (US) 32958

( * ) Notice: Subject to any disclaimer, the term of this patent is extended or adjusted under 35 U.S.C. 154(b) by 0 days.

(21) Appl. No.: 10/803,596

(22) Filed: Mar. 18, 2004

Related U.S. Application Data

(60) Provisional application No. 60/455,659, filed on Mar. 19, 2003.

(51) Int. Cl.
*B63H 5/125* (2006.01)

(52) U.S. Cl. ..... 440/57

(58) Field of Classification Search ..... 440/53, 440/57, 58–60, 75, 83, 111, 112, 54, 63
See application file for complete search history.

(56) References Cited

U.S. PATENT DOCUMENTS 1,980,685 A * 11/1934 Johnson ..... 440/58
2,335,597 A * 11/1943 Mathewson ..... 440/55
2,737,920 A * 3/1956 Heath ..... 440/61 R
4,037,558 A * 7/1977 Nossiter ..... 440/57
4,371,348 A * 2/1983 Blanchard ..... 440/52
4,790,782 A * 12/1988 McCormick ..... 440/61 R
4,909,767 A 3/1990 Hayasaka
5,108,325 A * 4/1992 Livingston et al. ..... 440/112
5,647,780 A * 7/1997 Hosoi ..... 440/53
6,146,221 A 11/2000 Natsume
6,247,979 B1 6/2001 Rigby
6,305,997 B1 10/2001 Whiteside et al.
6,371,820 B1 4/2002 Neisen et al.
6,454,620 B1 9/2002 Theisen et al.
6,468,120 B1 10/2002 Hasl et al.

* cited by examiner

*Primary Examiner*—Ed Swinehart

(57) ABSTRACT

A ball and socket joint assembly for a water vehicle outdrive system pivots both the trim-lift and the rudder as well as provides a reverse thrust without the need of a shifting mechanism. The ball and socket joint assembly includes a control mechanism for generating a user input and directing the outdrive system to rotate freely in a select arcuate path so that the water vehicle can be propelled in a corresponding direction, a ball and socket joint section operably connected to the control mechanism for cooperating therewith to selectively position the outdrive system corresponding to the user input, and a support mechanism for assisting to maintain the ball and socket joint section at a substantially stable position during operating conditions. The support mechanism is selectively operable independently of the control mechanism so that a user may pivot the outdrive during non-operating conditions, for maintenance, repairs and the like.

9 Claims, 7 Drawing Sheets

FIG.3
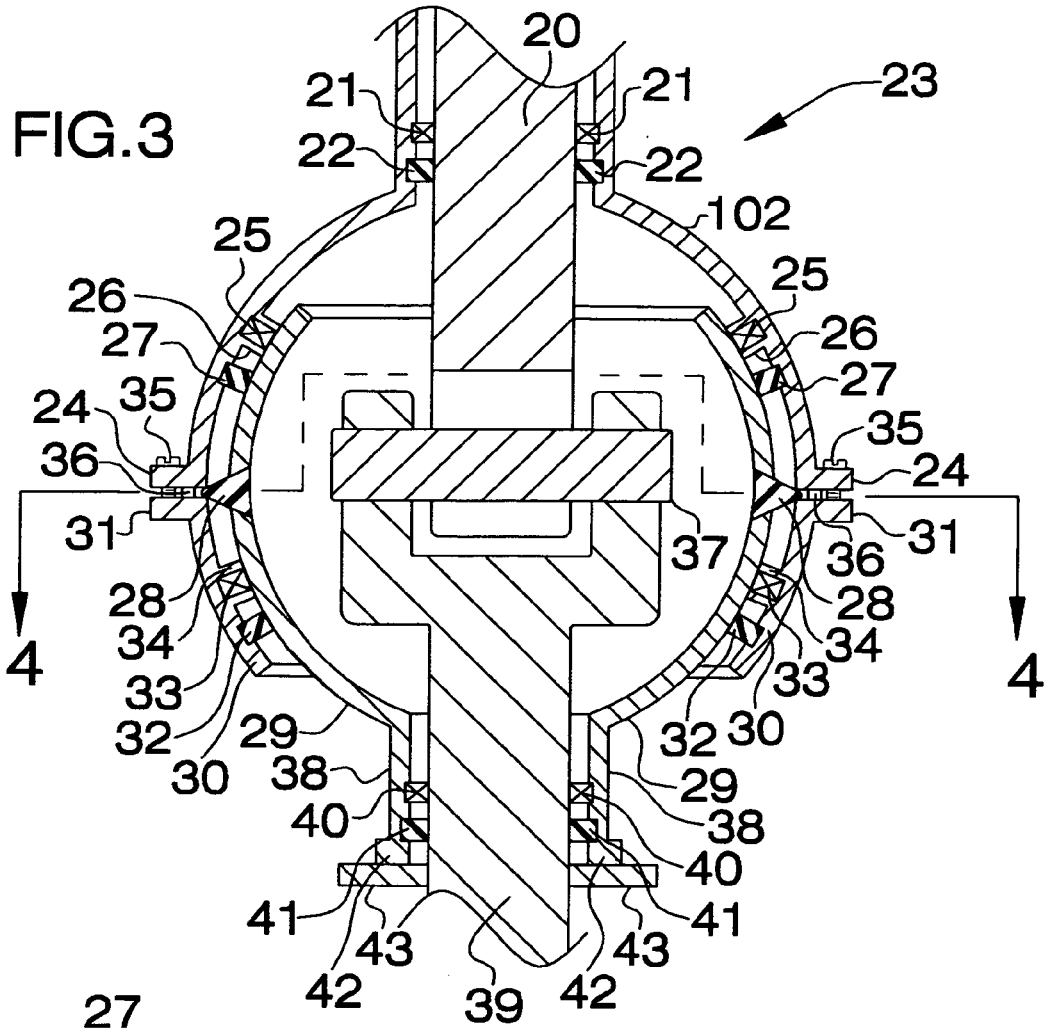
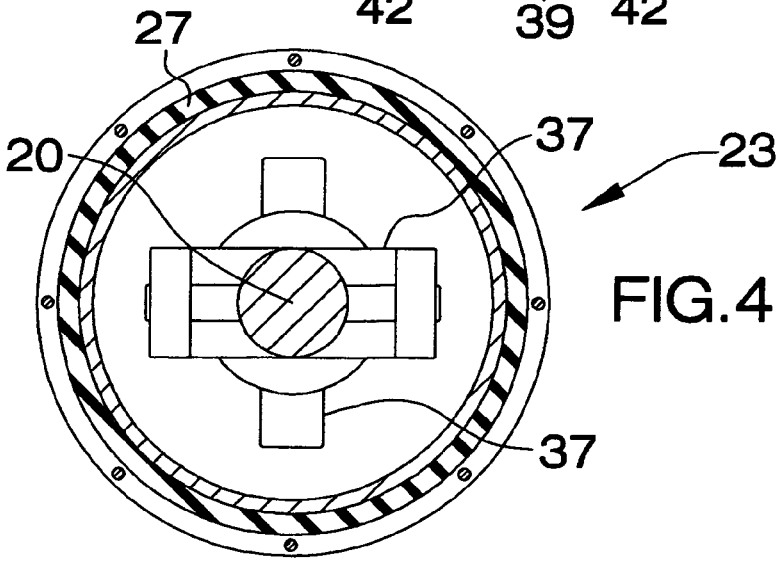
FIG.4

MARINE GIMBAL OUTDRIVE ASSEMBLY

CROSS REFERENCE TO RELATED APPLICATIONS

This application claims the benefit of U.S. Provisional Application No. 60/455,659, filed Mar. 19, 2003.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a marine ball outdrive assembly and, more particularly, to a marine ball and socket outdrive assembly for allowing an operator to selectively rotate the outdrive and thereby eliminate the necessity for a separate shift mechanism and other like accessories.

2. Prior Art

The majority of outdrive repair problems are not associated with the drive components (shafts, bearings, etc.) but more often accessory components such as water pumps, shifting mechanisms, water conduits etc., which are typically encased within the outdrive housing along with the drive components. Servicing such accessory components requires a time-consuming and tedious disassembly of the outdrive housing, which typically compromises the housings, seals and shafts that are not the cause of the service. By eliminating the need for a shifting mechanism and associated accessories, many problems associated with conventional accessories disposed with the outdrive housing can be effectively eliminated.

For outdrives powered by an engine, removing the water pump from within the outdrive provides improved operator accessibility for maintenance and also removes the need for water conduits within the outdrive housing. For outdrives powered by an electric motor, the water pump and other accessory components are not needed. Furthermore, diverting outdrive exhaust that is normally discharged in water will help improve water quality and thereby effectively eliminate the necessity for exhaust conduits within the outdrive housing. To move in reverse, the propeller should be pivoted 180 degrees.

Removing such components from the outdrive housing and placing the easily accessible steering mechanism on the exterior of the outdrive housing, makes disassembly of the outdrive a rare necessity and helps preserve the integrity of the outdrive. Moreover, the maneuverability of a water vehicle can be increased by the ability to turn the rudder or propeller position through a full range of 180 degrees. Such a rotational motion is not possible with conventional outdrives having gimbals employed in their respective rudders and trims.

BRIEF SUMMARY OF THE INVENTION

In view of the foregoing background, it is therefore an object of the present invention to provide marine ball and socket joint outdrive assembly for providing adaptable and convenient steering for pivoting a propeller about a central axis of a vertically-mounted ball and socket joint. These and other objects, features, and advantages of the invention are provided by a ball and socket joint assembly for a water vehicle outdrive system that includes a control mechanism for generating a user input and directing the outdrive system to rotate freely in a select arcuate path so that the water vehicle can be propelled in a corresponding direction. Such a arcuate path extends through at least 180 degrees, about a plurality of quadrants, for example. Of course, such a arcuate path may be selectively adjusted for accommodating its intended application. The trim-lift, rudder and reverse are executed at the same pivotal point within the ball and socket joint.

The present invention further includes a ball and socket joint section operably connected to the control mechanism and for cooperating therewith to selectively position the outdrive system, corresponding to the user input. Such a ball and socket joint section includes an upper housing secured to a water vehicle transom and extending rearwardly therefrom. The upper housing preferably includes a plurality of shafts and a beveled gear connected thereto, for transferring a first linear motion of one shaft to a second linear motion of another shaft wherein the first linear motion is disposed substantially orthogonal to the second linear motion.

The ball and socket joint section further includes a universal joint connected to one shaft for transmitting a non-linear rotation thereof so that the outdrive system can be rotated in clockwise and counter-clockwise directions, for example. A steering gear is operably connected to the control mechanism for cooperating therewith and for directing the water vehicle outdrive between select positions.

The present invention further includes a support mechanism for assisting to maintain the ball and socket joint section at a substantially stable position during operating conditions and is secured to a water vehicle transom and the ball and socket joint section respectively. Advantageously, such a support mechanism is selectively operable independently of the control mechanism so that a user may pivot the outdrive during non-operating conditions, for repairs and the like.

The support mechanism further includes a bracket provided with a plurality of elongated members secured along the boat transom and engageable with the ball and socket joint section. The plurality of members are preferably spaced along the boat transom and converge rearwardly toward the outdrive system.

The present invention further includes a plurality of hydraulic pumps and a plurality of hydraulic cylinders operably connected thereto. The plurality of hydraulic cylinders are connected to the trim plate for selectively pivoting the outdrive system between raised and lowered positions as the plurality of hydraulic cylinders are extended and retracted respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 3 is an enlarged cross-sectional view of the ball and socket joint assembly, taken along line 2—2;

FIG. 4 is a cross-sectional view of FIG. 3 showing a universal joint, taken along line 4—4;

DETAILED DESCRIPTION OF THE INVENTION

Figure 1:
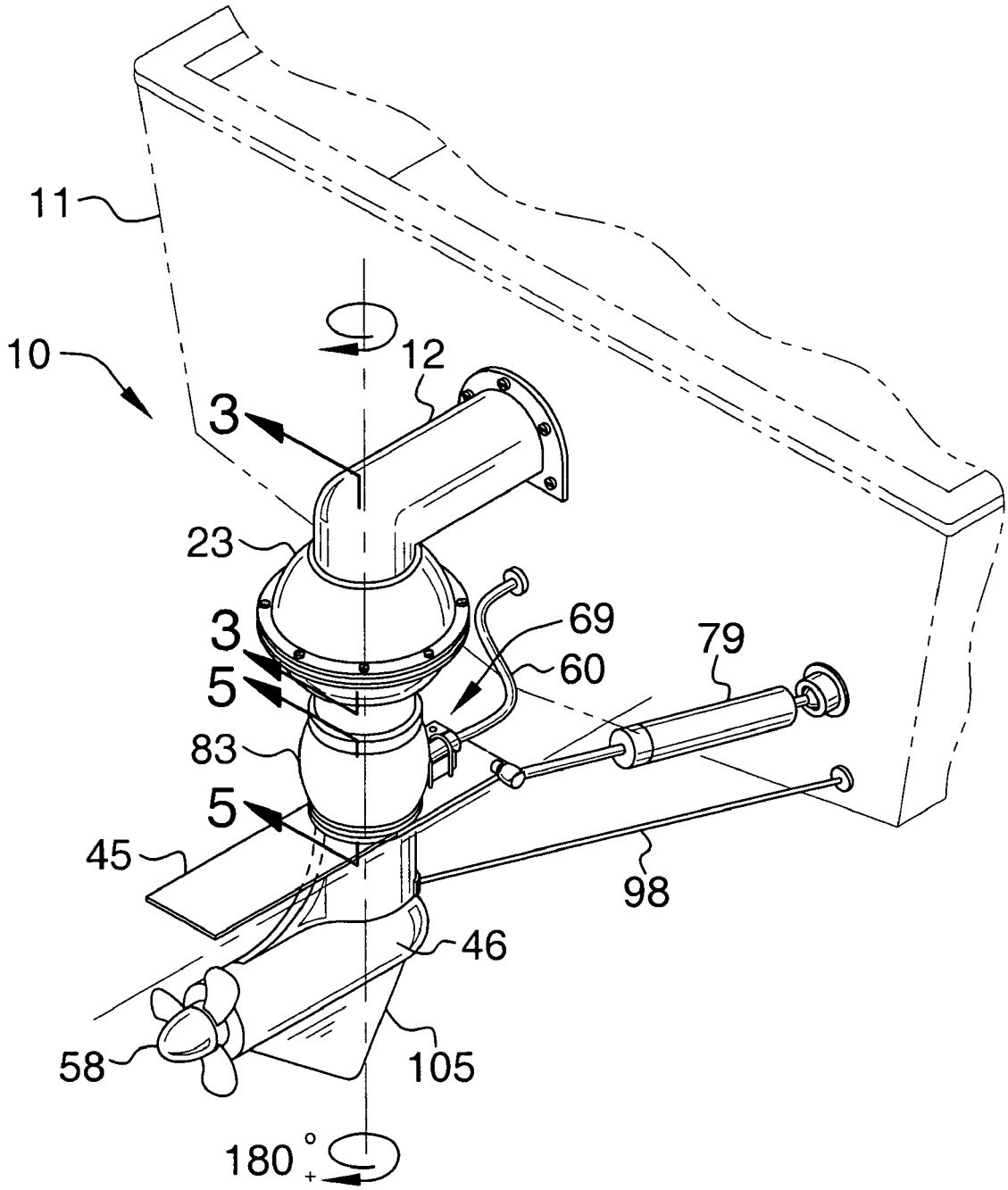
FIG. 1 is a partial perspective view showing a marine ball and socket joint outdrive assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–11 by the reference numeral 10 and is intended to provide a marine ball and socket joint outdrive assembly. It should be understood that the assembly 10 may be employed by various water vehicle power systems and should not be limited to only conventionally powered outdrives.

Referring initially to FIGS. 1–4, the present invention includes horizontal and vertical housings 12, 19 and 38, 46, respectively, which are preferably formed from a metal tube of sufficient diameter to encase shafts 15, 20, 39, 51 and 54, bearings 16, 21, 25, 33, 40, 52 and 55, seals 17, 22, 27, 28, 32, 41, 49, 53 and 57, and gears 18, 50, 56 and 103, respectively. The rigid upper horizontal housing 12, having an attached flange 13 and seal 14, mounts directly to a boat transom 11. The upper horizontal shaft 15, supported by bearings 16 and having a seal 17 at the transom end, protrudes through the boat transom 11.

At the juncture of the upper horizontal housing 12 and the upper vertical housing 19, the upper vertical shaft 20, supported by bearings 21 and having an attached gear 23, engages the upper horizontal shaft gear 18. The upper vertical shaft 20 having a seal 22 at the lower end of the upper vertical housing 19 extends into the upper portion of the ball and socket joint assembly 23, as perhaps best shown in FIG. 4.

Such a ball and socket joint assembly 23 includes an upper ball and socket joint section 102, a lower ball and socket joint section 29 and a ball and socket joint retainer 30 provided with a series of ball and socket joint bearings 25, 33 and seals 27, 28, 32 respectively disposed between the upper ball and socket joint section 102, lower ball and socket joint section 29 and ball and socket joint retainer 30. The upper ball and socket joint section 102 further has an opening at the upper end thereof for accommodating shaft 20, which extends downwardly from the upper vertical housing 19. The upper ball and socket joint section 102 has a half sphere-like shape provided with a flange portion 24 extending outwardly therefrom and about an outer perimeter thereof.

Such a flange portion 24 has a series of apertures formed therein and around the circumference thereof to receive a plurality of bolts 35. The upper ball and socket joint section 102 further has a series of flanges 26 spaced about the inner diameter thereof. Such flanges 26 maintain the upper ball and socket joint seal 27 spaced below the ball and socket joint bearings 25.

The upper end of the lower vertical housing 38 is attached to the lower end of the lower ball and socket joint section 29. Such a lower ball and socket joint section 29 is shaped into a truncated sphere and is provided with an opening at the upper end to accept a universal joint 37, as well known to a person of ordinary skill in the art. In particular, such a lower end opening receives shaft 39 therethrough. Notably, the lower ball and socket joint section 29 has a smaller diameter than the upper ball and socket joint section 102 so that lower ball and socket joint section 29 can be positioned within the upper ball and socket joint section 102 for contacting the upper ball and socket joint bearings 25 and upper ball and socket joint seals 27 mounted within the upper ball and socket joint section 102, respectively. The lower ball and socket joint section 29 houses the universal joint 37, which joins upper and lower vertical shafts 20, 39, respectively.

Referring to FIG. 4 in more detail, the upper ball and socket joint section 102 and lower ball and socket joint section 29 are secured with a ball and socket joint retainer 30, which is a truncated half sphere having a corresponding diameter, contour and outer flange portion 31 as upper ball and socket joint section 102. Such a flange portion 31 is disposed adjacent the truncated inner end portion and cooperates with the upper ball and socket joint flange portion 24 for receiving a conventional fastening member such as a bolt therethrough.

A ball and socket joint retainer seal 32 is also positioned adjacent the truncated inner end and a series of ball and socket joint retainer bearings 33 are disposed outwardly therefrom. The ball and socket joint retainer 30 encircles the lower ball and socket joint section 29 and is bolted to the upper ball and socket joint outer flange portion 24. Notably, a lower ball and socket joint seal 28 is disposed between the upper ball and socket joint flange portion 24 and a ball and socket joint retainer flange portion 31 extends about the diameter of the lower ball and socket joint section 29. A plurality of spacers 36 are disposed between the upper ball and socket joint flange portion 24 and the ball and socket joint retainer flange portion 31 so the spatial distance between the upper 102 and lower ball and socket joint section 29 housings can be selectively adjusted, as needed during operating conditions or maintenance.

Figure 10:
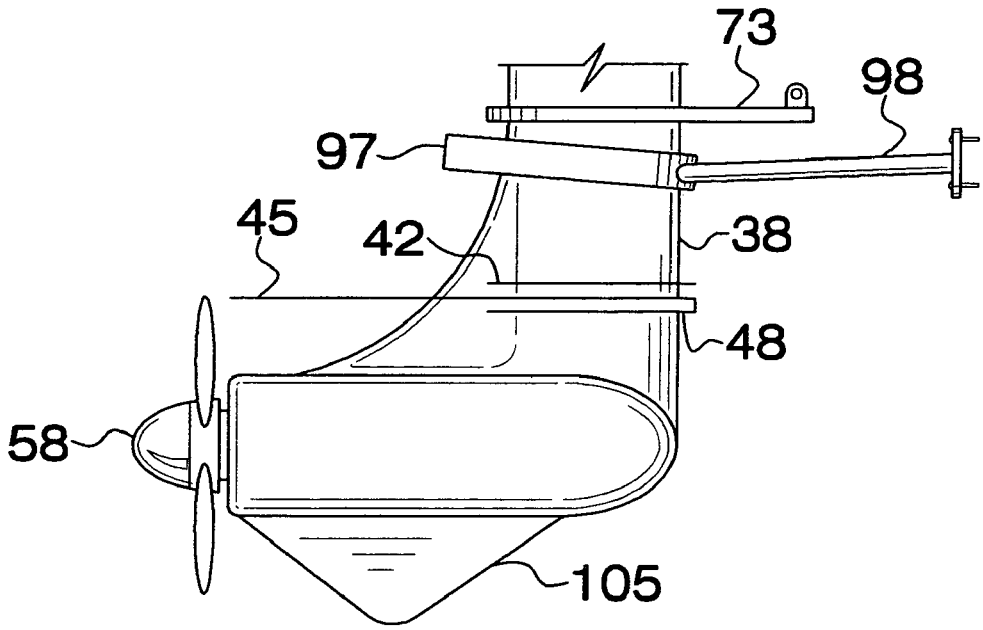
FIG. 10 is an enlarged side-elevational view of the lower vertical housing stabilizer forming part of the support mechanism of the present invention and also shows the cavitation plate secured to the lower vertical housing flange portion as well as the skeg extending downwardly from the lower horizontal housing.
Figure 11:
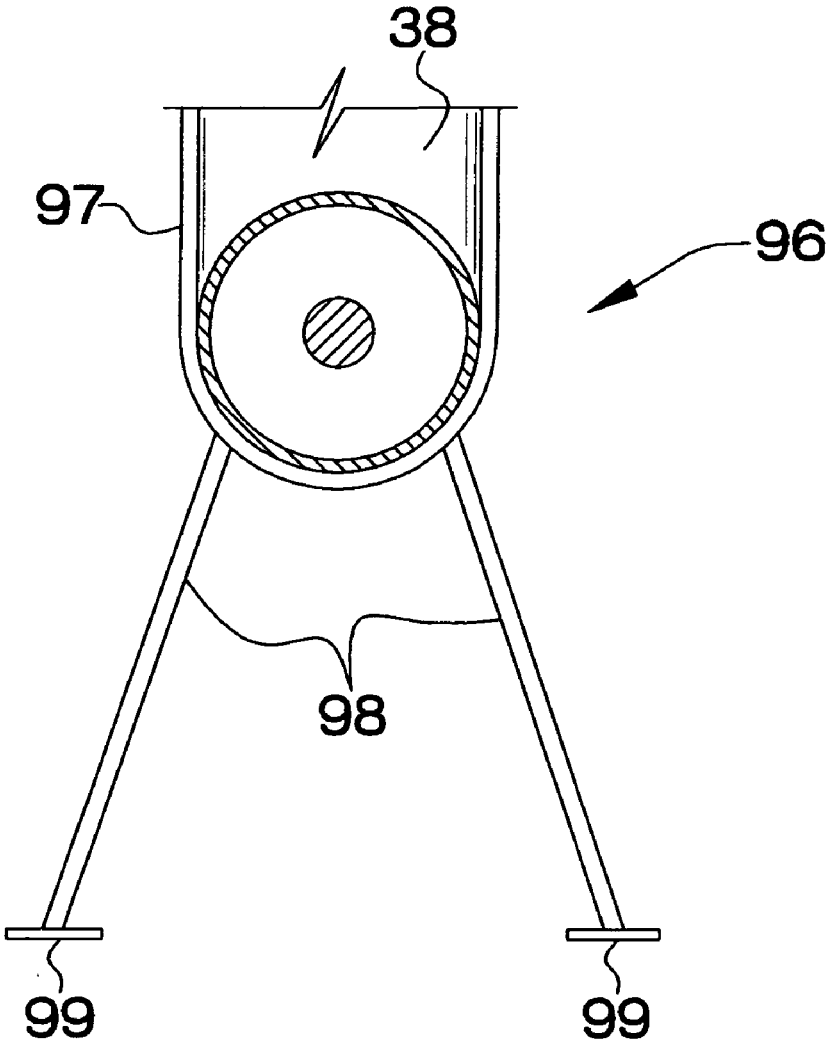
FIG. 11 is an enlarged top plan view of the lower vertical housing stabilizer shown in FIG. 10.

Now referring to FIGS. 10 and 11, a support mechanism for assisting to maintain the gimbal section at a substantially stable position during operating conditions is secured to the water vehicle transom and the gimbal section respectively. Such a support mechanism is selectively operable independently of the control mechanism and includes a lower vertical housing stabilizer 96 including a U-shaped metal bracket 97 having sufficient size and strength to support the thrust of the propeller 58. Of course, such a U-shaped bracket 97 can be modified to accommodate the diameter of the lower vertical housing 47. Bracket 97 preferably engages the front of housing 47 and extends rearwardly therefrom where it joins mounting bracket 98. A mounting bracket 98 having a plurality of elongated support members are connected thereto and extend forwardly therefrom for being secured to the boat transom via a plurality of corresponding mounting flanges 99, as perhaps better shown in FIG. 2. Such a mounting bracket 98 diverges outwardly and forwardly from bracket 97 for assisting to maintain the propeller 58 at a substantially stable position during operating conditions. Advantageously, the U-shaped bracket 97 has a front portion offset above a horizontal plane so that the propeller 58 can be effectively pivoted between raised and lowered trim positions.

Figure 5:
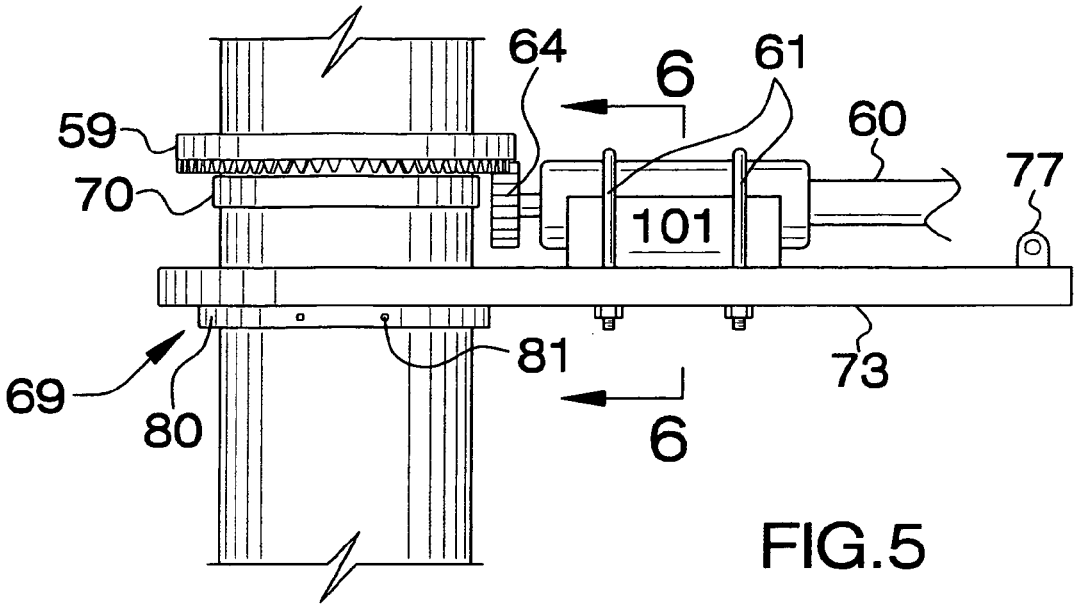
FIG. 5 is an enlarged side-elevational view of the ball and socket joint assembly shown in FIG. 1 with the shroud removed therefrom, taken along line 5—5.
Figure 6:
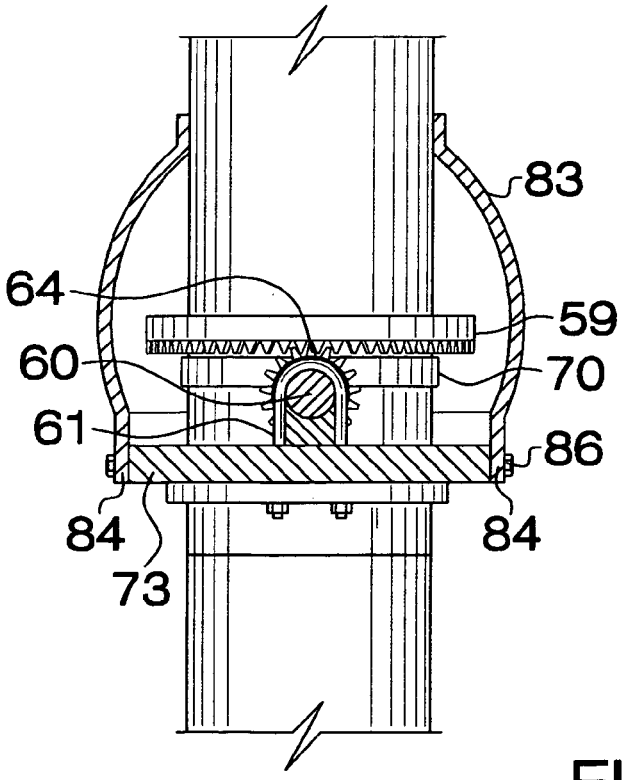
FIG. 6 is an enlarged cross-sectional view of FIG. 5 showing the flexible steering shaft connection with the trim plate assembly and also the cross-section of the shroud, taken along line 6—6.
Figure 7:
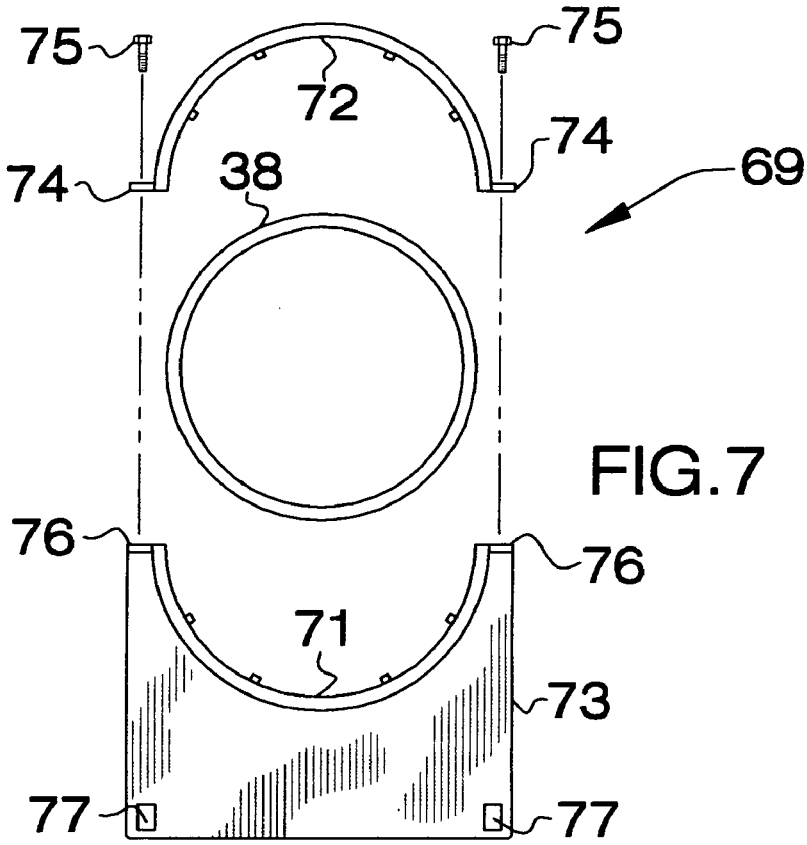
FIG. 7 is an enlarged top plan view of the trim plate assembly shown in FIG. 2.

Now referring to FIGS. 5–7, the support mechanism further includes a trim plate assembly 69 including a pair of U-shaped semi-circular bearing retainers 71, 72 and a substantially planar metal trim plate 73 with an arcuate portion corresponding to the shape of the bearing retainers 71, 72. Such bearing retainers 71, 72 include a series of bearings, which encircle the lower vertical housing 38. The inner bearing retainer 71 is mounted to a semi-circular seat provided by the trim plate 73. The outer bearing retainer 72 is mounted to the trim plate 73 by a plurality of mounting flanges 74.

Such a plurality of mounting flanges 74 are disposed at opposite ends of the outer bearing retainer 72 and extend outwardly therefrom at approximately a ninety degree angle. Such mounting flanges 74 are provided with a plurality of corresponding apertures 76 that correspond to the threaded apertures on the trim plate 73, as perhaps best shown in FIG. 7. Notably, the trim plate 73 includes a plurality of oppositely spaced connectors 77 for receiving a plurality of hydraulic cylinder shafts 78 disposed adjacent the trim plate 73.

In particular, the hydraulic cylinder shafts 78 are attached on opposed sides of the trim plate 73 and are slidably engageable with corresponding hydraulic cylinders 79 secured to the boat transom 11 on opposed sides of the vertical housing 38. Advantageously, the hydraulic cylinders 79 provide fore and aft movement for the lift and trim and help stabilize the trim plate 73.

Figure 2:
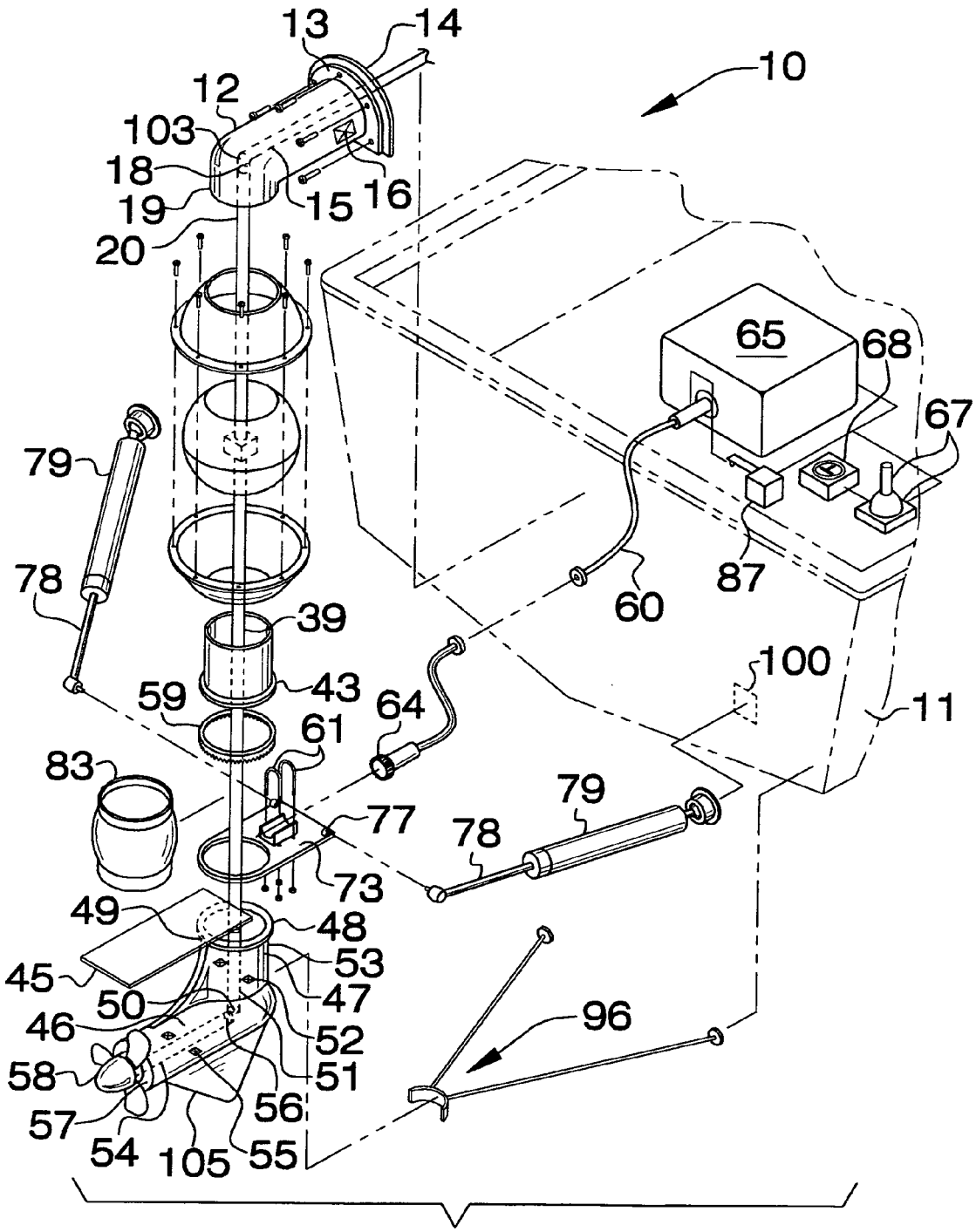
FIG. 2 is an exploded view of FIG. 1 further including a control mechanism connected to the ball and socket joint section as well as additional elements forming the support mechanism of the present invention.

Referring to FIGS. 2, 3 and 6, the present invention 10 further includes a trim plate 73 and a lower gimbal 29 oriented in a substantially vertical position. Such a lower gimbal 29 has a central point. A plurality of hydraulic cylinder shafts 79 are attached to the trim plate 73 in such a manner such that the lower gimbal 29 can be moved to a vertical position while the central point of the lower gimbal 29 remains at a static location. The lower gimbal 29 raises the lower horizontal housing 46 vertically away from a water surface for providing ground clearance when the water vehicle is out of the water.

Still referring to FIGS. 2, 3 and 6, the lower horizontal housing 46 is operably connected to the lower gimbal 29 wherein small vertical movements of the lower horizontal housing 46 affect the attitude of the water vehicle when in motion. The present invention 10 further includes a steering gear 59 operably connected to the lower gimbal 29 in such a manner that the steering gear 59 can horizontally adapt the lower gimbal 29 while the central point of the lower gimbal 29 remains at a static location. The lower gimbal 29 is repeatedly rotatable along a path extending approximately 180 degrees defined between a forward position and a reverse position while the central point of the lower gimbal 29 remains at a static position.

Referring to FIGS. 3 and 5 in more detail, the trim plate assembly 69 is supported by a trim plate retainer 80 mounted to the lower vertical housing 38 below the trim plate assembly 69. Such a trim plate retainer 80 has a pair of semi-circular sleeves securable to each other via a plurality of bolts 81, which encircle the lower ball and socket joint section 29. The trim plate retainer 80 has a series of threaded holes disposed around its circumference and are secured to the lower vertical housing 38 with conventional cap screws. Referring to FIG. 6 in more detail, a metal spacer 70 is located above the trim plate assembly 73, encircles the lower vertical housing 38 and includes a pair of joined semi-circular sections.

A flexible shaft mount 101 rests on the trim plate 73 and supports the flexible steering shaft 60 by providing operating clearance for the flexible shaft drive gear 64. The shaft mount 101 has a rectangular shape and is formed from metal or other suitable material, and further has a substantially concave top surface for providing a seat to receive the flexible steering shaft 60 thereon. The flexible steering shaft 60 is secured to the mount 101 via a plurality of U-bolts 61 fastened through the trim plate 73, as perhaps best shown in FIG. 5.

The steering gear 59 is secured to the lower vertical housing 38, above the spacer 70. Now referring to FIGS. 2 and 9, steering is accomplished with a flexible shaft steering system (control mechanism) including a flexible steering shaft 60 connected to an electric steering motor 65 shaft 66 located interior the water vehicle.

Figure 9:
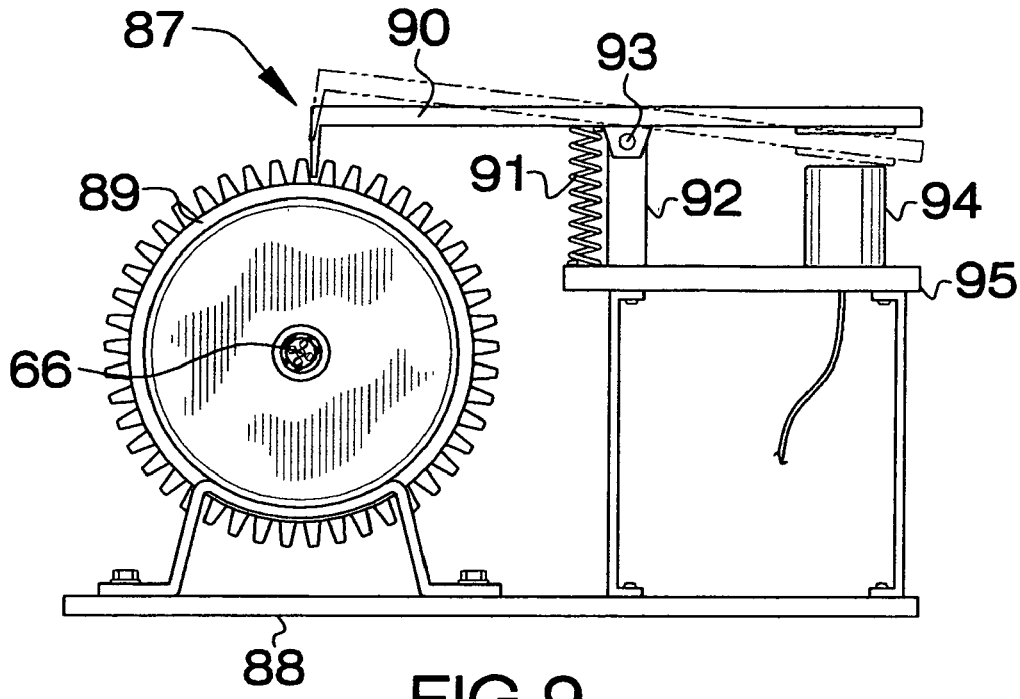
FIG. 9 is an enlarged side-elevational view showing the major elements of the steering lock assembly shown in FIG. 8.

Referring to FIG. 2, a control mechanism for generating a user input and directing the outdrive system to rotate freely in a select radial path so that the water vehicle can be propelled in a corresponding direction includes the following elements: an electrical steering motor 65, a drive gear 64, a toggle switch 67, an electrical rudder position indicator 68, and a steering lock assembly 87. Referring to FIG. 9, such a control mechanism also includes a steering motor shaft 66 and a toothed gear 89 mounted thereon, a steering motor 88, a locking lever 90, a spring member 91, a pivot 92, a pivot pin 93, a spring loaded electro magnet 94, and amounting platform 95.

The flexible steering shaft 60 is inserted through the boat transom 11 and has a drive gear 64 attached on the opposite end from the electrical steering motor 65. Such a drive gear 64 is mounted on the trim plate 73 and engages the steering gear 59. The electric steering motor 65 is controlled with a momentary on-off toggle switch 67 mounted at the helm of the water vehicle. An electrical rudder position indicator 68 is also mounted at the helm for indicating the rudder position during operating conditions.

Of course, such a flexible shaft steering system is not limited to electrically-powered motors. For example, manually-powered steering systems may be employed without departing from the true scope of the present invention. In particular, a wheel and drum system such as the "GLEN-L steering kit #06-400", well known to a person of ordinary skill in the art, may be employed by using an interior transom mounted cable drum with two running cable ends connected via a cable clamp for providing a continuous running cable. Another example may include the "OMC TRUE COURSE" steering system wherein the flexible shaft 60 is attached to the transom mounted cable drum shaft, for example.

Figure 8:
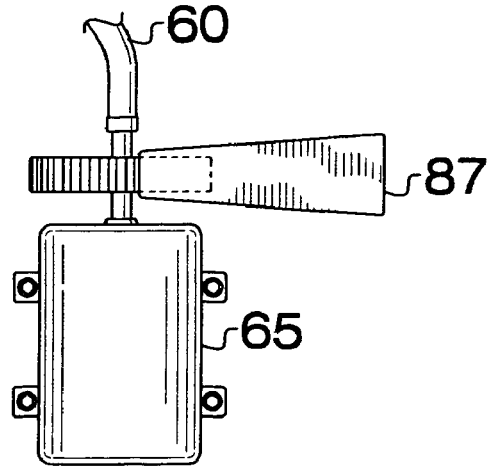
FIG. 8 is an enlarged top plan view of the steering lock assembly shown in FIG. 2.

Referring back to the present invention, the rudder position is maintained by a steering lock assembly 87 mounted on the same platform as the steering motor 88, as perhaps best shown in FIGS. 8 and 9. The steering lock assembly 87 includes a spring-loaded electro magnet 94 secured to a mounting platform 95 that activates a locking lever 90 for engaging a toothed gear 89 mounted on an electric steering motor shaft 66. The locking lever 90 is secured to a pivot 92 by a pivot pin 93 and the toothed gear 89 is positioned between the flexible steering shaft 60 and the electric steering motor 65.

In operation, when the toggle switch 67 is activated and the electromagnet 94 activates the locking lever 90 for disengaging the toothed gear 89, the flexible steering shaft 60 is allowed to rotate. Conversely, when the toggle switch 67 is moved to the off position, spring member 91 pulls the locking lever 90 downwardly for engaging the toothed gear 89 and thereby immobilizes the rudder.

Referring back to FIGS. 2 and 3, the lower end portion of the lower vertical housing 38 has a flange portion 42 provided with a series of bolt apertures and seals 43 to join the corresponding lower horizontal housing flange and seal 48, 49, respectively. A conventional cavitation plate 45 is mounted between the above-referenced flange portions 42 and 48, respectively, and for assisting to prevent propeller aeration, as well known to a person of ordinary skill in the art.

The lower horizontal housing 46 encases the propeller shaft 54 supported by bearings 55 and is provided with an attached gear 56 at the inward end portion thereof. A short vertical housing portion includes a shaft 51 supported by bearings 52 having an attached gear 50 at the lower end that engages the propeller shaft gear 56. A seal 57 is attached to the lower horizontal housing 46 forward of the propeller 58. The skeg 105 protects the propeller 58 during operating conditions if the water vehicle strikes a submerged object, while also improving the performance of the rudder.

Referring to FIGS. 2 and 6 in more detail, a steering gear shroud 83 is advantageously provided to protect the steering gear 59 and flexible steering shaft drive gear 64 from seaweed and other debris commonly found in water. The steering gear shroud 83 includes a protective cover formed from durable material and encases the steering gear 59 and flexible steering shaft drive gear 64. The shroud 83 is vertically divided and is provided with overlapping vertical seams, wherein an upper end portion encircles the lower vertical housing 38, and a lower end portion is attached to the trim plate assembly 69. Such vertical seams are fastened together via a plurality of conventional cap screws 86.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A ball and socket joint assembly for a water vehicle outdrive system, said assembly comprising:

control means for generating a user input and directing the outdrive system to rotate freely in a select arcuate path so that the water vehicle can be propelled in a corresponding direction;

a ball and socket joint section operably connected to said control means and for cooperating therewith to selectively position the outdrive system corresponding to said user input; and support means for assisting to maintain said ball and socket joint section at a substantially stable position during operating conditions, said support means being secured to a water vehicle transom and said ball and socket joint section respectively, said support means being selectively operable independently of said control means;

wherein said support means comprises a bracket including a plurality of elongated members secured along the water vehicle transom and engageable with said ball and socket joint section, said plurality of members being spaced along the water vehicle transom and converging rearwardly toward the outdrive system;

wherein said ball and socket joint section further comprises a steering gear operably connected to said control means and for cooperating therewith to direct the outdrive system between select positions.

2. The ball and socket joint assembly of claim 1, wherein said ball and socket joint section comprises:

an upper housing secured to the water vehicle transom and extending rearwardly therefrom, said upper housing comprising a plurality of shafts and a beveled gear arrangement connected thereto and for transferring a first rotational motion of one of said plurality of shafts to a second rotational motion of another of said plurality of shafts wherein the first rotational motion is disposed substantially orthogonal to the second rotational motion.

3. The ball and socket joint assembly of claim 2, wherein said ball and socket joint section further comprises:

a universal joint connected to another said plurality of shafts with said ball and socket joint assembly for transmitting a non-linear rotation thereof so that the outdrive system can be rotated in clockwise and counter-clockwise directions.

4. The marine ball and socket joint assembly of claim 1, wherein the arcuate path extends at least 180 degrees and about a plurality of quadrants.

5. A ball and socket joint assembly for a water vehicle outdrive system, said assembly comprising:

control means for generating a user input and directing the outdrive system to rotate freely in a select arcuate path extending at least 90 degrees and about a quadrant so that the water vehicle can be propelled in a corresponding direction;

a ball and socket joint section operably connected to said control means and for cooperating therewith to selectively position the outdrive system corresponding to said user input; and support means for assisting to maintain said ball and socket joint section at a substantially stable position during operating conditions, said support means being secured to a water vehicle transom and said ball and socket joint section respectively, said support means being selectively operable independently of said control means;

wherein said support means comprises a bracket including a plurality of elongated members secured along the boat transom and engageable with said ball and socket joint section, said plurality of members being spaced along the water vehicle transom and converging rearwardly toward the outdrive system.

6. The ball and socket joint assembly of claim 5, wherein said ball and socket joint section comprises:

an upper housing secured to the water vehicle transom and extending rearwardly therefrom, said upper housing comprising a plurality of shafts and a beveled gear arrangement connected thereto and for transferring a first rotational motion of one of said plurality of shafts to a second rotational motion of another of said plurality of shafts wherein the first rotational motion is disposed substantially orthogonal to the second rotational motion.

7. The ball and socket joint assembly of claim 6, wherein said ball and socket joint section further comprises:

a universal joint connected to another said plurality of shafts with said ball and socket joint assembly transmitting a non-linear rotation thereof so that the outdrive system can be rotated in clockwise and counter-clockwise directions.

8. The ball and socket joint assembly of claim 5, wherein said ball and socket joint section further comprises:

a steering gear operably connected to said control means and for cooperating therewith to direct the outdrive system between select positions.

9. A ball and socket joint assembly for a water vehicle outdrive system, said assembly comprising:

a trim plate;

lower ball and socket joint section oriented in a substantially vertical position, said lower ball and socket joint section having a central point;

a lower horizontal housing operably connected to said lower ball and socket joint section;

a plurality of hydraulic cylinder shafts attached to said trim plate in such a manner such that said lower ball and socket joint section can be moved to a arcuate position while said central point of said lower ball and socket joint section remains at a static location, said lower ball and socket joint section raising said lower horizontal housing arcuately away from a water surface for providing ground clearance when the water vehicle is out of the water;

wherein small arcuate movements of said lower horizontal housing affect the attitude of the water vehicle when in motion;

a steering gear operably connected to said lower ball and socket joint section in such a manner that said steering gear can horizontally adapt said lower ball and socket joint section while said central point of said lower ball and socket joint section remains at a static location; and said lower ball and socket joint section being repeatedly rotatable along a path extending at least 180 degrees defined between a forward position and a reverse position while said central point of said lower ball and socket joint section remains at a static position.

* * * * *